United States Patent [19]

Spector

[11] 4,041,304

[45] Aug. 9, 1977

[54] FLASHLIGHT

[76] Inventor: Samuel Spector, Box 404, York Beach, Maine 03910

[21] Appl. No.: 651,344

[22] Filed: Jan. 22, 1976

[51] Int. Cl.[2] ..... F21D 7/00; F21V 23/04

[52] U.S. Cl. ..... 240/10.68; 200/60

[58] Field of Search ..... 200/60; 240/10.66, 10.68

[56] References Cited

U.S. PATENT DOCUMENTS

| | | | |
|---|---|---|---|
| 1,111,546 | 9/1914 | Oelman | 240/10.66 |
| 1,187,105 | 6/1916 | Sagebrecht | 240/10.68 |
| 1,591,627 | 7/1926 | Hopkins | 240/10.68 |
| 1,669,292 | 5/1928 | Eckstein | 240/10.66 |
| 1,839,971 | 1/1932 | Korsen | 240/10.66 |
| 2,019,884 | 11/1935 | Beaumont | 240/10.68 |
| 2,236,384 | 3/1941 | Samuels | 240/10.68 X |
| 2,396,046 | 3/1946 | Hipwell et al. | 240/10.66 |
| 2,483,819 | 10/1949 | Falge | 240/10.68 |
| 3,079,492 | 2/1963 | Bolinger | 200/60 X |
| 3,147,927 | 9/1964 | Steele et al. | 240/10.66 |
| 3,457,398 | 7/1969 | Figa | 240/10.68 |

*Primary Examiner*—Donald A. Griffin

*Attorney, Agent, or Firm*—Morse, Altman, Oates & Bello

[57] ABSTRACT

A flashlight is disclosed that is comprised of a disposable battery section and a reusable head section detachably connected to one another. The battery section comprises one or more batteries enclosed in a low-cost tube of cardboard or the like, the batteries being disposed in end-to-end relation. The tube is formed with an aperture exposing the metal casing of the lowermost battery, and a strip of aluminum foil, coated with a stratum of pressure sensitive adhesive, is applied along the length of the tube and over the aperture. The head is detachably connected onto the upper end of the tube and is of a conductive metal to complete a circuit with the aluminum strip. The flashlight is turned on by pressing the aluminum strip over the aperture to close contact with the battery.

3 Claims, 8 Drawing Figures

FLASHLIGHT

BACKGROUND OF THE INVENTION

1. Field of the Invention

This invention relates generally to flashlights and more particularly is directed toward a new and improved lowcost flashlight featuring a disposable battery section and a reusable head section.

2. Description of the Prior Art

Conventional hand flashlights generally comprise a rigid metal or plastic tube adapted to contain batteries inserted in end-to-end relation with a removable bottom cover which closes the end of the flashlight and applies pressure to the batteries against a head which contains the bulb and reflector. A switch is normally built into the side of the flashlight in order to turn it on and off. Conventional flashlights of this type are relatively expensive and frequently are ruined by corrosion of batteries left in too long after their power has been depleted. While a great many disposable flashlights have been developed and are available, such flashlights have been unsatisfactory for various reasons including designs that require large capital investments to produce the flashlight, costs that are not much less than those of a standard flashlight, or, tend to be unreliable in operation.

Accordingly, it is an object of the present invention to provide a new and improved flashlight of extremely low cost construction and yet reliable in operation. A further object of this invention is to provide a battery unit which is disposable and adapted and adapted to be used in conjunction with a reusable flashlight head.

SUMMARY OF THE INVENTION

This invention features a disposable battery unit comprised of one or more batteries assembled in end-to-end relation and contained within a stiff tube of cardboard or the like, the ends of which are crimped to prevent the batteries from coming loose. The tube is formed with an aperture which is adjacent the lowermost battery, and a strip of aluminum foil is applied along the side of the tube and over the aperture. The aperture exposes the metal casing by depressing the foil against the battery. A replaceable head of conductive metal is adapted to be connected to the upper end of the tube and includes a reflector and a bulb to form a flashlight.

DETAILED DESCRIPTION OF THE PREFERRED EMBODIMENT

Figure 1:
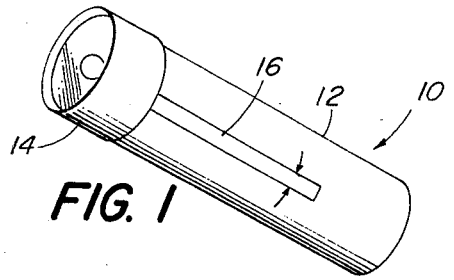
FIG. 1 is a view in perspective of a flashlight made according to the invention.
Figure 4:
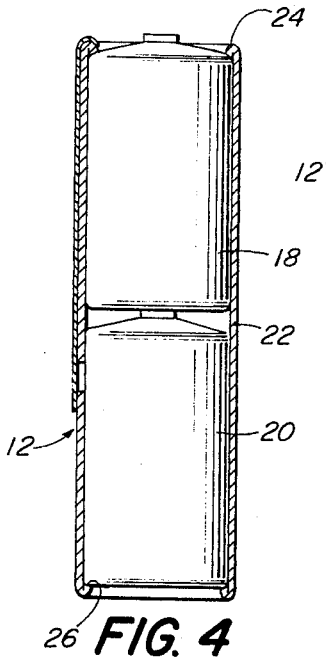
FIG. 4 is a sectional view in side elevation of the battery section.
Figure 3:
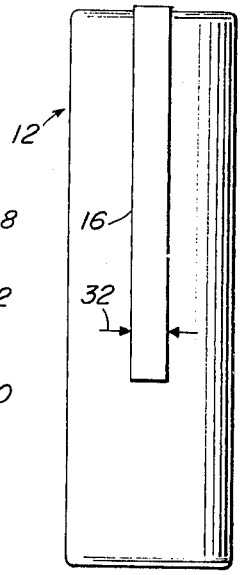
FIG. 3 is a view in side elevation of the battery section.

Referring to the drawings, the reference character 10 generally indicates a flashlight made according to the invention and comprised of a disposable battery section 12 and a reusable head section 14 detachably connected thereto. The flashlight is actuated by means of a strip 16 of electrically conductive aluminum foil applied along the outer surface of the battery section and adapted to close contact with the lowermost of a pair of batteries 18 and 20 within the battery section by pressing on the strip 16 at the lower end thereof.

The battery section, as best shown in FIGS. 3 through 6, is comprised of the batteries 18 and 20 which are mounted in end-to-end relation and held together by means of a tubular sleeve 22 fitted tightly over the batteries with the batteries held against axial displacement by means of crimped ends 24 and 26 which engage, respectively, the upper end of the battery 18 and the lower end of the battery 20. While the illustrated embodiment shows two batteries in the battery section, obviously the number may be increased or decreased as desired. In any event, the sleeve 22 preferably is fabricated of an inexpensive dielectric material, and for this purpose cardboard is particularly satisfactory since it is stiff enough to provide structural strength to the battery section, is electrically insulating, and is of very low cost.

The batteries within the sleeve have their metal sides fully exposed and are covered only by the cardboard sleeve 22. The sleeve 22 is imperforate throughout with the exception of a single opening 28 formed in the side thereof adjacent the lowermost battery 20. The opening is relatively small and typically may be on the order of perhaps 1/2" in diameter.

Applied along the length of the sleeve 22 on the outer face thereof is the strip 16 of aluminum foil which extends from the top of the sleeve down to a point just below the opening 28. The foil is sufficiently wide to fully cover the opening 28 and this may be best seen in FIG. 6. The strip 16 is held in position by means of a pressure sensitive adhesive stratum 30 which covers the inner face of the strip, with the exception of that portion spanning the opening 28. In this fashion, a circuit may be completed between the batteries 18 and 20 and the aluminum strip 16 by pressing the strip at its lower end through the opening 28 so that the strip contacts the side of the battery 20. The resiliency of the cardboard sleeve 22 is such that the aluminum foil will move out of contact with the battery as soon as the pressure on the strip is released. The strip may be pressed by means of the holder's thumb squeezing the strip against the battery over the opening 28. In order to allow the holder to more easily locate the position of the opening which is obscured by the aluminum strip, a suitable indicia 32, in the form of a circle or arrow, for example, may be imprinted on the cardboard sleeve proximate to the opening and visible on either side of the aluminum strip.

Figure 2:
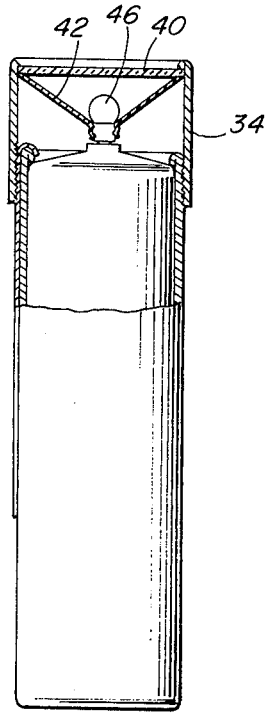
FIG. 2 is a view in side elevation, partly in section, of the flashlight assembly.
Figure 7:
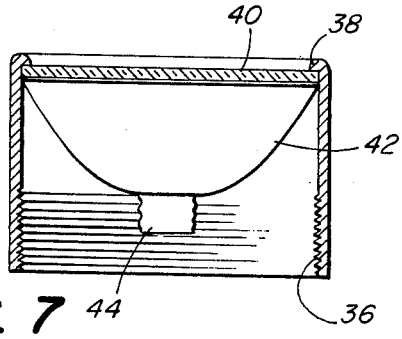
FIG. 7 is a sectional view in side elevation of the reflector head unit, and, FIG. 8 is a sectional view in side elevation showing a modification of the invention.
Figure 5:
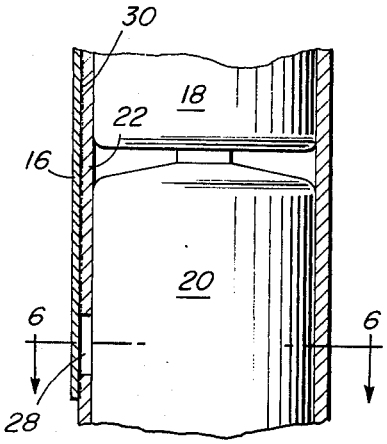
FIG. 5 is a detailed sectional view in side elevation showing the switch arrangement.
Figure 6:
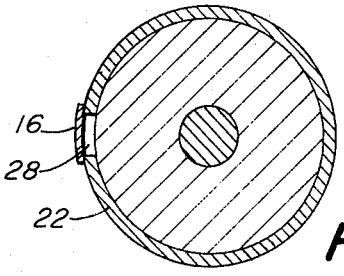
FIG. 6 is a cross-sectional view taken along the lines 6—6 of FIG. 5.

The reusable head 14, as best shown in FIGS. 2 and 7, is comprised of a conductive metal collar 34 formed with internal threads 36 about the lower inner face thereof and having its upper end crimped over at 38 in order to grip a transparent plastic lens 40 and a metal reflector 42 pressed therein. The refector 42 is conical or concave, as desired, and its upper face is formed with a highly reflective finish. The lower end of the reflector terminates in a tapped socket 44 to receive a bulb 46.

The head is connected to the battery section by screwing the threaded collar over the upper end of the battery section directly onto the cardboard sleeve. In position, the collar 34 forms a circuit with the aluminum strip 16 and the circuit is completed to the bulb 46 through the metal reflector 42. The bulb 46 bears against the top of the uppermost battery 18 so that the bulb will be illuminated when the strip 16 is pressed against the battery 20 through the opening 28.

Once the flashlight has been used to the extent that the batteries are exhausted, the battery section may be unscrewed from the head 14 and discarded. A fresh battery section 12 may then be connected to the head 14. Since the battery section is comprised of very low-cost components, the selling price of the battery section may be competitive with the price of batteries alone. Furthermore, the battery section may be used for other purposes than with flashlights. For example, many types of toys, small tools, motors and the like are operated by means of batteries and the battery section can be readily utilized for such purposes.

Figure 8:
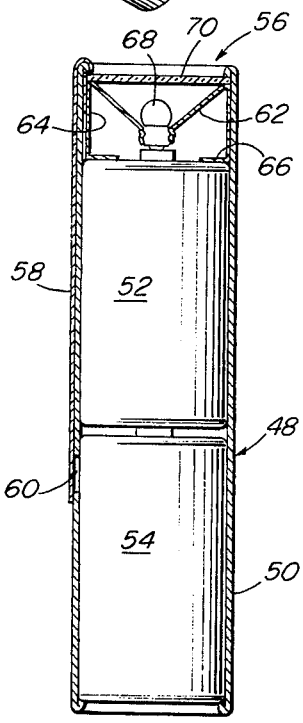

Referring now to FIG. 8 of the drawings, there is illustrated a modification of the invention, and, in this embodiment a fully disposable flashlight 48 is dislcosed. The flashlight includes a sleeve 50 similar to the sleeve of the principal embodiment but extending the full length of the flashlight to enclose batteries 52 and 54 and a head assembly 56. The ends of the sleeve 50 are crimped as before and a flexible aluminum strip 58 is applied along the side of the sleeve from an aperture 60 to the upper end of sleeve where it contacts the head assembly. The head assembly 56 includes a one-piece reflector 62 having an integral cylindrical collar 64 terminating at the lower edge in an inwardly extending flange 66 serving as a stop for the batteries. A bulb 68 is mounted in a socket at the base of the reflector and a lens 70 may be provided. The head assembly of this embodiment is of simple, low-cost construction so that, for a slight additional cost, the entire flashlight is made disposable.

Having thus described the invention, what I claim and desire to obtain by Letters Patent of the United States is:

1. A disposable flashlight, comprising a. at least one metal-clad cylindrical battery, b. a dielectric cylindrical sleeve engaging the sides of said battery and coextensive therewith, c. the lower end of said sleeve being crimped over the lower end of said battery d. said sleeve being formed with a relatively small opening to expose the metal side of said battery, e. a narrow strip of aluminum foil slightly wider than said opening bonded to the outer surface of said sleeve and extending lengthwise therealong from the upper end of said sleeve to at least over said opening to fully cover said opening and form a switch therewith, f. a head mounted in the upper end of said sleeve, g. said head being formed with an electrically conductive sleeve adapted to engage the upper, inner face of said sleeve and contact said strip, h. conductive reflector integral with said sleeve and a bulb mounted to said reflector and in contact with said battery, and, i. the upper end of said sleeve being crimped over said head.

2. A disposable battery section, according to claim 1, wherein said strip is covered over its inner face with a pressure-sensitive adhesive material exclusive of that portion spanning said opening.

3. A disposable battery section, according to claim 2 including visible indicia on said sleeve proximate to said opening.

* * * * *